US008439005B2

(12) United States Patent
Yasutomi et al.

(10) Patent No.: US 8,439,005 B2
(45) Date of Patent: May 14, 2013

(54) TWO CYCLE ENGINE AND TOOL

(75) Inventors: Toshinori Yasutomi, Ibaraki (JP); Shinki Ohtsu, Ibaraki (JP); Junichi Kamimura, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 653 days.

(21) Appl. No.: 12/540,272

(22) Filed: Aug. 12, 2009

(65) Prior Publication Data

US 2010/0037875 A1 Feb. 18, 2010

(30) Foreign Application Priority Data

Aug. 12, 2008 (JP) ..... 2008-208273

(51) Int. Cl.
*F02B 25/00* (2006.01)

(52) U.S. Cl.
USPC ..... 123/65 A; 123/65 PD

(58) Field of Classification Search ..... 123/65 P, 123/65 A, 65 PD, 73 PP
See application file for complete search history.

(56) References Cited

U.S. PATENT DOCUMENTS

| | | | | |
|---|---|---|---|---|
| 2,044,552 | A * | 6/1936 | Heinrich | 123/65 V |
| 2,406,404 | A * | 8/1946 | Ryde | 123/73 A |
| 2,724,372 | A * | 11/1955 | Schowalter | 123/65 A |
| 3,494,335 | A * | 2/1970 | Meier | 123/65 R |
| 3,815,558 | A * | 6/1974 | Tenney | 123/73 A |
| 4,373,474 | A * | 2/1983 | Schindler et al. | 123/55.7 |
| 2007/0028868 | A1 | 2/2007 | Tsutsui | |

FOREIGN PATENT DOCUMENTS

| | | | |
|---|---|---|---|
| JP | 58-096124 | A | 6/1983 |
| JP | 2008-296443 | A | 11/1996 |
| JP | 10-266860 | A | 10/1998 |
| JP | 2001-214745 | A | 8/2001 |
| JP | 2006-348785 | A | 12/2006 |

OTHER PUBLICATIONS

Corresponding Chinese Office Action of Apr. 22, 2011 and English translation thereof.
Japan Patent Office Action for patent application JP2008-208273 (Feb. 28, 2012).

* cited by examiner

*Primary Examiner* — Noah Kamen
*Assistant Examiner* — Hung Q Nguyen
(74) *Attorney, Agent, or Firm* — Kilpatrick Townsend & Stockton LLP

(57) ABSTRACT

A two cycle engine has an exhaust port provided in a side portion of a cylinder, and a scavenge air port provided in the side portion of the cylinder so as to be symmetrical with a plane passing through a center in a cylinder circumference direction of the exhaust port and an axis extending to inside of the cylinder, the scavenge air port is structured such that an axis extending to inside of the cylinder from an opening of the scavenge air port extends in such a direction as to be away from the exhaust port of the cylinder, and is divided in a cylinder axis direction by a dividing portion.

4 Claims, 12 Drawing Sheets

TWO CYCLE ENGINE AND TOOL

BACKGROUND OF THE INVENTION

1. Field of the Invention

The present invention relates to a two cycle engine, and more particularly to a two cycle engine suitable for handheld power tools powered by an engine, such as a bush cutter, a chain saw, a blower or the like, and a tool using the engine.

2. Description of the Related Art

There have conventionally been known two cycle engines with improved outputs achieved by contrivance to the number and shape of their scavenge air passages or exhaust ports.

For example, a two cycle engine described in Patent Literature 1 is provided with, within its scavenge air passage, a straightening vane that divides the scavenge air passage into two in an upper-and-lower direction. The straightening vane directs air-fuel mixture flowing out of the upper opening of the scavenge air port by the air-fuel mixture flowing out of the lower opening so that the air-fuel-mixture flows from both openings flow in similar flow lines within a cylinder.

Patent literature 1: Unexamined Japanese Patent Application KOKAI Publication No. H08-296443

However, according to the two cycle engine of the patent literature 1, there is a disadvantage of undesirable gas mixture between the mixed gas in the cylinder and a combustion gas at the finish of one scavenging stroke from where the piston travels further to a top dead center. This undesirable mixture is caused by gas residue within the cylinder, resulting from ineffective scavenge of the combustion gas in the center portion of the cylinder, which is due to the straightening vane guiding the air-fuel mixture flowing out of the upper and lower openings of the scavenge air port toward an ignition plug through the inner wall surface of the cylinder at each scavenge stroke. Problematically, the undesirable gas mixture produces low concentration of the mixed gas that results in lowered output of the engine.

SUMMARY OF THE INVENTION

The present invention is made in view of the above-described problem, and an object of the present invention is to provide a two cycle engine that can improve an output by effective scavenging, and a tool provided with such a two cycle engine.

In order to solve the problem, according to the present invention, there is provided a two cycle engine comprising:

an exhaust port provided in a side portion of a cylinder; and at least a pair of scavenge air ports provided in the side portion of the cylinder so as to be symmetrical with respect to a plane including an axis of the cylinder and a center line in a cylinder circumference direction of the exhaust port, wherein each scavenge air port is so oriented that, as viewed in a cylinder axis direction, an axis extending to inside of the cylinder from an opening of the scavenge air port extends in such a direction as to be away from the exhaust port of the cylinder, and the scavenge air port is divided in the cylinder axis direction.

In this case, a dividing portion dividing the scavenge air port in the cylinder axis direction may be structured such that its thickness decreases according to a distance from the cylinder in a cross-section taken by cutting the dividing portion along a plane through which passes the center line in the cylinder circumference direction of the scavenge air port and which is in parallel with the cylinder axis, and which is along a direction of scavenge air flowing through each scavenge air port.

Further, it is preferable that in the cross-section taken by cutting the dividing portion along a plane including the axis of the cylinder and the center line in the cylinder circumference direction of the scavenge air port, a prolongation prolonged from an top-dead-center-side wall of the scavenge air port of a top-dead-center side is angled toward the top dead center side with respect to a line that is vertical to the axis of the cylinder, and the angle formed by the two lines:

(a) the prolongation from the top-dead-center-side wall of the scavenge air port of the top-dead-center side; and (b) the line that is vertical to the cylinder axis is larger than an angle formed by the line (b) and (c) a prolongation into the cylinder from a top-dead-center-side wall of the scavenge air port of the bottom-dead-center side.

This cylinder may be further provided with a second scavenge air port that locates more apart from the exhaust port than the scavenge air port, and is adjacent to the scavenge air ports.

Further, a tool according to the present invention is a tool that is provided with any two cycle engines mentioned above.

According to the present invention, the axis extending to inside of the cylinder from an opening of the scavenge air port extends in a direction opposite to the exhaust port as viewed in a cylinder axis direction, and the scavenge air port is divided in the cylinder axis direction. Therefore, it is possible to achieved a two cycle engine with improved outputs in which the air-fuel mixture flowing out of the scavenge air port in to the cylinder can effectively scavenge a combustion gas remaining in the cylinder.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

The following describes a preferred embodiment of the present invention, with reference to the accompanied drawings.

Figure 1:
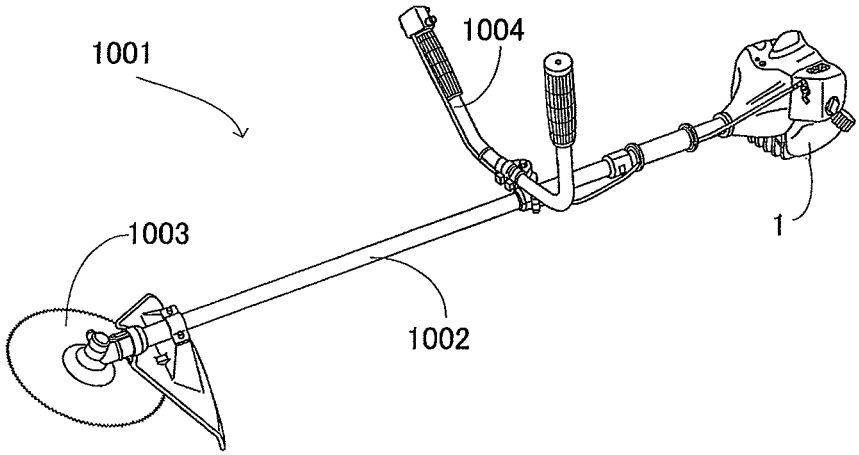
FIG. 1 shows an exterior of a bush cutter according to an embodiment of the present invention.

FIG. 1 shows a bush cutter 1001 on which a two cycle engine (hereinafter referred to as an engine) 1 according to a first embodiment of the present invention is mounted. As shown in FIG. 1, a rotary blade 1003 is attached to a front end of a control rod 1002 of the bush cutter 1001, and an engine 1 is attached to a rear end of the control rod 1002. The power of the engine 1 is supplied to the rotary blade 1003 via a drive shaft that is inserted into the control rod 1002. An operator grips a handle 1004 attached to the control rod 1002 to operate the bush cutter 1001.

Figure 2:
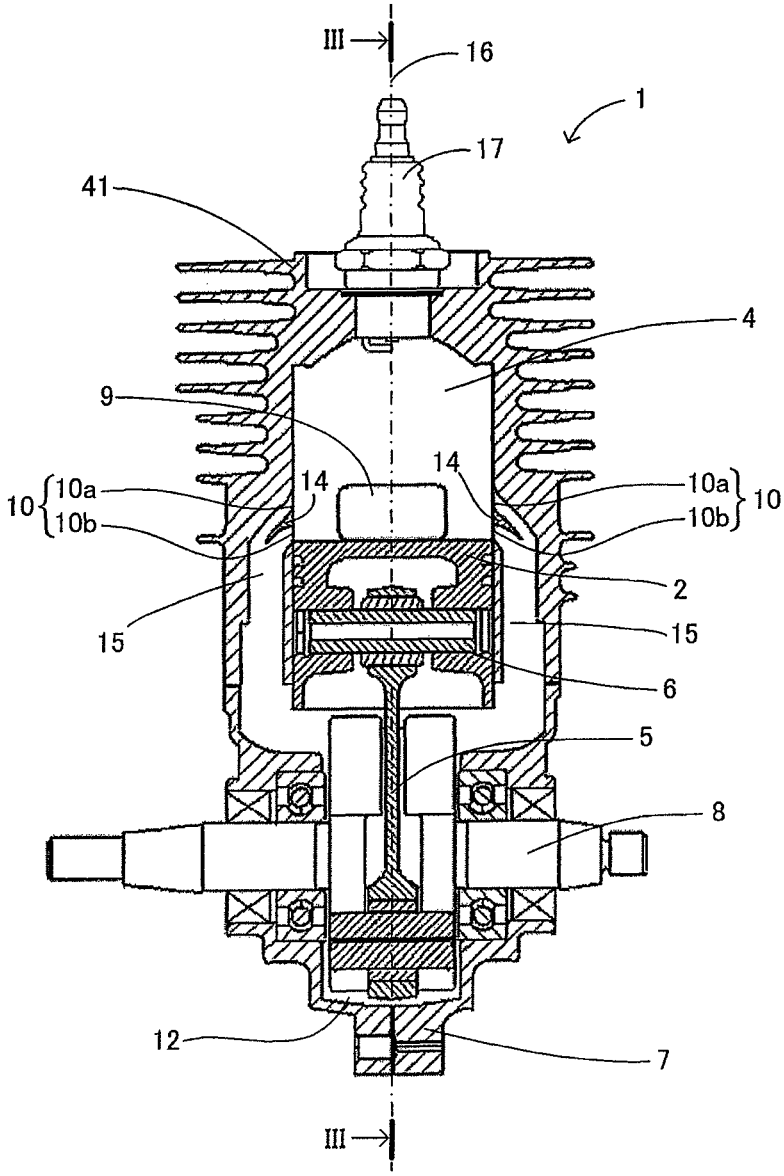
FIG. 2 shows an elevated view in section of an engine according to an embodiment of the present invention.

The engine 1 is constructed as shown in FIGS. 2 to 6. Specifically, as shown in FIG. 2, a crank case 7 is attached to a cylinder block 41 of the engine 1. A piston 2 travels reciprocally in a direction of a cylinder axis 16 (up and down) within a cylinder 4 of the cylinder block 41 (FIG. 2 shows a state in which the piston 2 reaches a bottom dead center). Further, the cylinder 4 has an ignition plug 17 attached in an upper part thereof, and is connected to a crank chamber 12 within the crank case 7 in the lower part. Further, the piston 2 is connected to a crank shaft 8 via a piston pin 6 and a connecting rod 5. The crank shaft 8 is rotatably supported in the crank case 7. Further, an exhaust port 9 is open on a side of the cylinder 4, passes through the cylinder block 41 in a depth direction (a direction which is vertical to the surface of the sheet of FIG. 2), and exhausts a combustion gas from the cylinder 4. Further, a pair of scavenge air ports 10 are formed in the cylinder block 41 so as to be symmetrical with respect to the cylinder 4 (symmetrical with respect to a plane including a cylinder axis 16 and a center line dividing the exhaust port 9 into two in a circumferential direction of the cylinder 4). Each of the scavenge air ports 10 communicates with the crank chamber 12 via a scavenge air passage 15. Further, the scavenge air port 10 is divided into upper and lower ones (divided in a direction of the cylinder axis 16) by a dividing portion 14, and forms scavenge air port 10*a* of a top-dead-center side and a scavenge air port 10*b* of a bottom-dead-center side. This dividing portion 14 has an approximately wedge-shaped cross section as shown in FIG. 2, that is, a cross section such that its thickness increases according to closeness to the cylinder 4. An end of the dividing portion extends into the scavenge air passage 15. Further, one edge of the exhaust port 9 which is closer than the other edges to the top dead center is located more closely to the top dead center than one edge of the scavenge air port 10 which is the closer of the scavenge airports to the top dead center (the scavenge air port 10*a* of the top-dead-center side). Accordingly, when the piston 2 moves from the top dead center to the bottom dead center, the exhaust port 9 opens against the cylinder 4 before the scavenge air port 10 opens.

Figure 3:
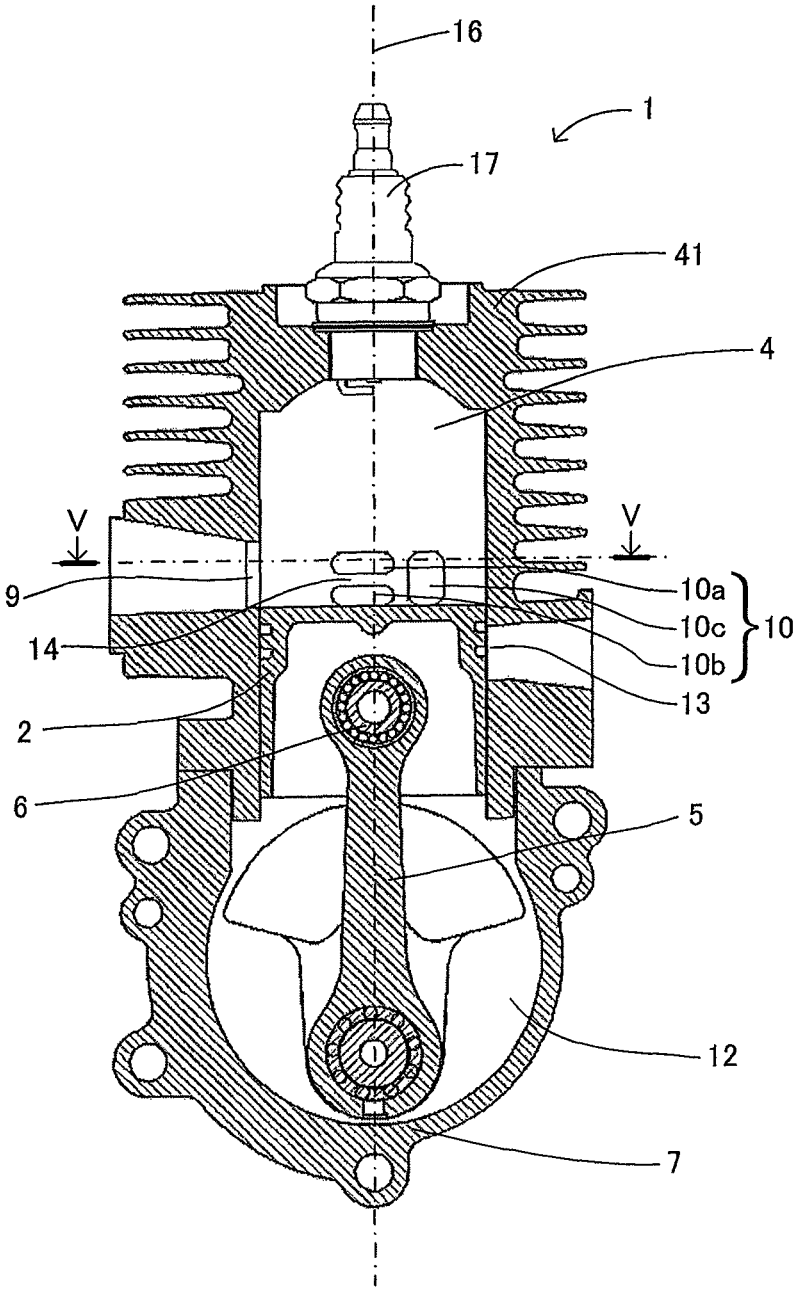
FIG. 3 shows an elevated view in section of the engine taken along a line III-III of FIG. 2.

As shown in FIG. 3, the cylinder block 41 is provided with an intake port 13. The intake port 13 is opened to supply an air-fuel mixture to the crank chamber 12 when the piston 2 is in the vicinity of the top dead center (in an intake stroke). Further, a scavenge air port 10*c* (a second scavenge air port) of a side opposite to the exhaust port 9, is provided at a position described as follows. The position is farther from the exhaust port 9 than the scavenge air ports 10*a* and 10*b* in the cylinder circumference direction (in the side opposite to the exhaust port (close to the intake port 13)) in the cylinder block 41. At this position the scavenge air port 10*c* is adjacent to the scavenge air ports 10*a* and 10*b*. In other words, the scavenge air port 10 comprises the scavenge air port 10*a* of the top-dead-center side, the scavenge air port 10*b* of the bottom-dead-center side, and the scavenge air port 10*c* of the side which is opposite to exhaust port.

Figure 4:
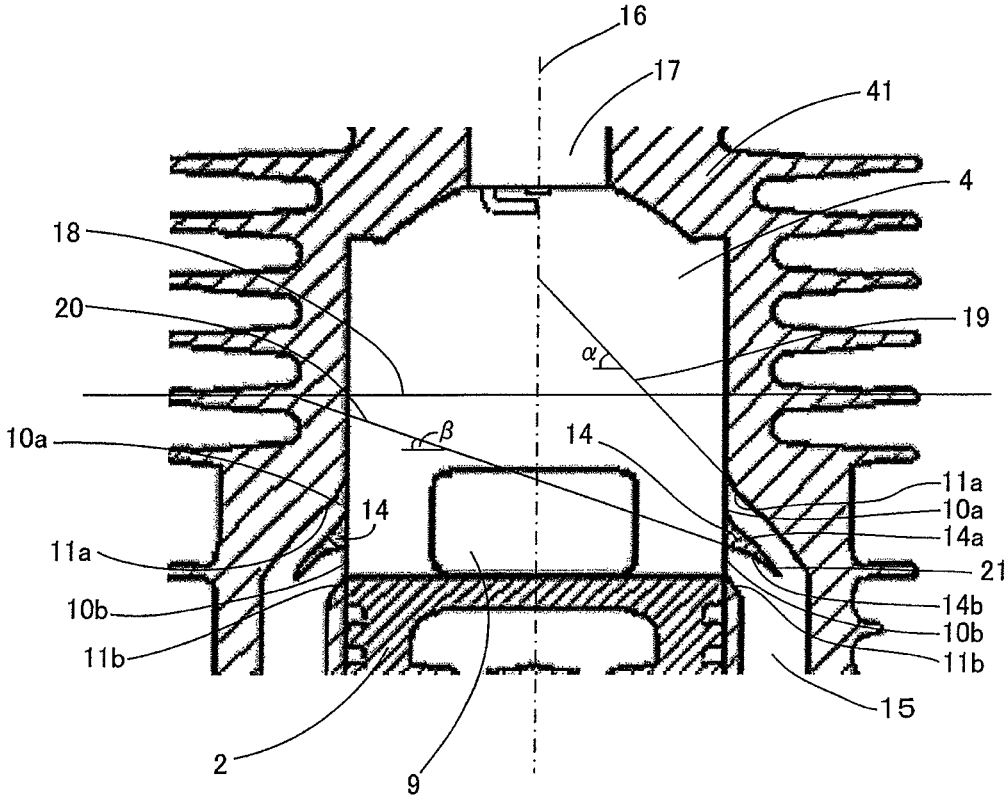
FIG. 4 is an enlarged view of a principal part of FIG. 1.

As shown in FIG. 4, the scavenge air ports 10*a* and 10*b* of the scavenge air port 10 opens with inclinations at different angles in the top-dead-center direction within the cylinder 4 (a diagonally upper direction in the drawing). Further, the inclination of an axis of the scavenge air port 10*a* with respect to a surface that is vertical to an axis of the cylinder 4 is larger than an inclination of an axis of the scavenge air port 10*b* with respect to the surface. Further, the axis of the scavenge air port 10*a* is inclined to the top dead center side by an angle larger than the axis of the scavenge air port 10*b*, within the cylinder 4.

When a cross section (a cross section in FIG. 4) is taken along a plane that includes a center line that equally segments the scavenge air port 10*a* in the cylinder circumference direction of the cylinder 4 and that includes the cylinder axis 16, such a configuration as follows is preferable. An intersection, at which a prolongation 19 prolonged into the cylinder 4 from the top-dead-center-side wall surface 11*a* of the scavenge air port 10*a* crosses with the cylinder axis 16, is set more closely to the top dead center than a plane 18. The plane 18 is a surface on which a top surface of the piston 2 is when the piston 2 is at an intermediate point between the top dead center and the bottom dead center. Further, it is preferable that an intersection, at which a prolongation 20, prolonged into the cylinder 4, of the bottom-dead-center-side wall surface 14*b* of the dividing portion crosses with the cylinder axis 16, is positioned more closely to the bottom dead center than the plane 18.

Alternatively, the intersection of the prolongation 19 and the plane 18 may exist more closely to the scavenge air port 10*a* than the cylinder axis 16, while the intersection of the prolongation 20 and the plane 18 may be provided on the opposed side where the other scavenge air port 10*a* opposes beyond the cylinder axis 16, or may exist outside the cylinder 4.

Further, an angle formed by the scavenge air port 10*a* and the line that is vertical to the cylinder axis 16 or the plane 18 may be larger than an angle formed by the scavenge air port 10*b* and the line that is vertical to the cylinder axis 16 or the plane 18. For example, an angle $\alpha$ formed by the prolongation 19 and the plane 18, and an angle $\beta$ formed by the prolongation 20 and the plane 18 have a relationship $\alpha>\beta$.

Alternatively, the structure may be such that a relationship $\alpha>\beta$ is established for an angle $\alpha$ formed by the prolongation obtained by extending into the cylinder 4 the top-dead-center-side wall surface 14*a* of the dividing portion and the plane 18, and an angle $\beta$ formed by the prolongation obtained by extending into the cylinder 4 the bottom-dead-center-side wall surface 14*b* of the dividing portion 14 or the bottom-dead-center-side wall surface 11*b* of the scavenge air port 10*b* and the plane 18.

Further, the structure may be such that any relationship mentioned above is satisfied by the prolongation obtained by extending to the cylinder 4 the line that equally segments, in the direction of the cylinder axis 16, each of the scavenge air ports 10*a* and 10*b*, or by the flowing direction of the air-fuel mixture flowing into the cylinder 4 from each of the scavenge air ports 10*a* and 10*b*.

In this case, in a cross section (a cross section in FIG. 4) obtained by cutting the cylinder 4 by the plane including the center line equally dividing the scavenge air port 10*a* of the top-dead-center side in the circumferential direction of the cylinder 4 and the cylinder axis 16, the dividing portion 14 has a cross sectional shape that tapers off according to the distance from the cylinder 4 in the scavenge air passage 15. For example, the dividing portion 14 has such a cross sectional shape that the prolongation in the direction to be away from the cylinder 4 of the top-dead-center-side wall surface 14*a* of the dividing portion crosses the prolongation 20 of the bottom-dead-center-side wall surface 14*b* of the dividing portion at the intersection 21 within the scavenge air passage 15.

Figure 5:
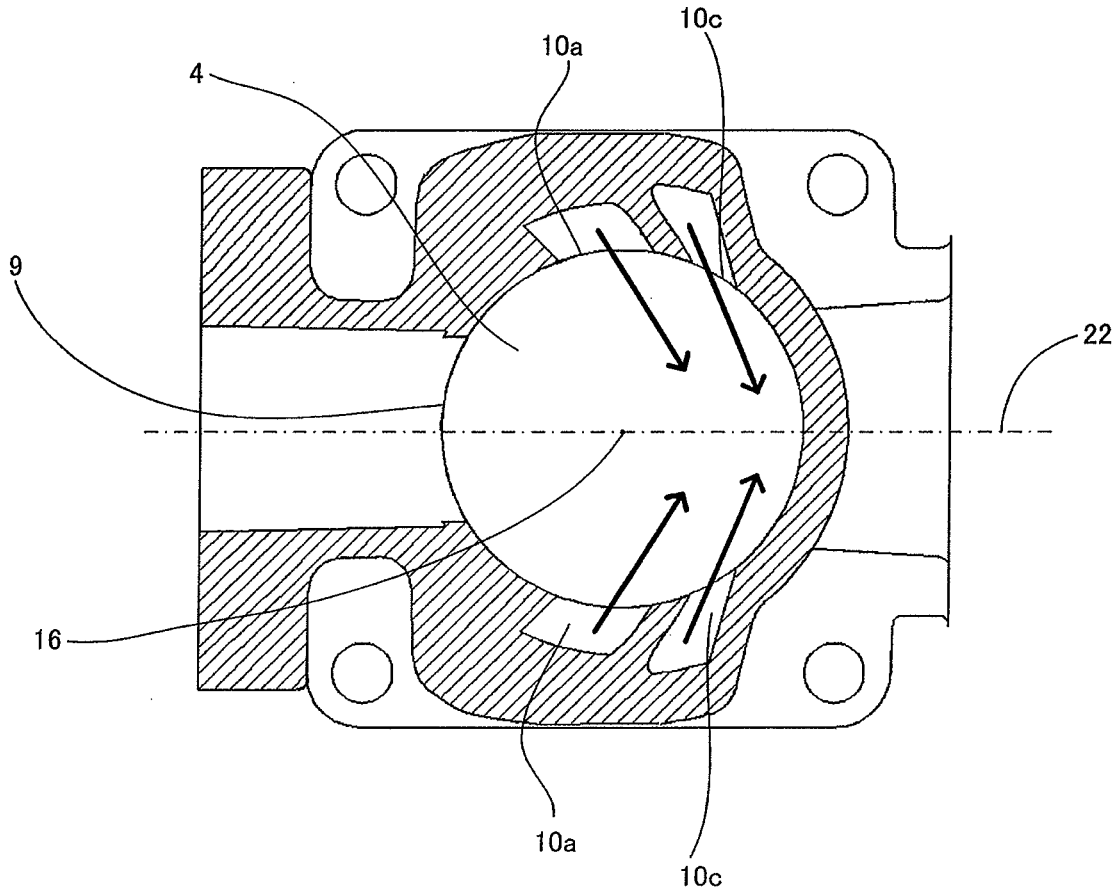
FIG. 5 is a transversal cross sectional view of the engine, taken along a line V-V of FIG. 3.

As shown in FIG. 5, when viewed in the cylinder axis direction (illustrating a cross section along a plane that is vertical to the cylinder axis 16), the scavenge air port 10*a*, the scavenge air port 10*b* (not shown), and the scavenge air port 10*c* are arranged symmetrically with respect to a plane 22 that passes through the cylinder axis 16 and equally divides the exhaust port 9 in the circumference direction of the cylinder 4. Further, each of the scavenge air ports 10*a*, 10*b*, and 10*c* is opened in such a direction as to be away from the exhaust port 9 (to be close to the intake port 13). In this case, an axis of the scavenge air port 10*b* (not shown) agrees with the axis of the scavenge air port 10*a*.

In other words, the axis into the cylinder 4 from each opening of the scavenge air ports 10*a*, 10*b*, and 10*c* extends in such a direction as to be away from the exhaust port 9. Here, the "axis" refers to an axis which is representative of the flow lines of the gas passing through each of the scavenge air ports 10*a*, 10*b*, and 10*c*. In other words, the gas flowing into the cylinder 4 through each of the scavenge air ports 10*a*, 10*b*, and 10*c* flows in a direction along the axis of each of the scavenge air ports 10*a*, 10*b*, and 10*c*. For example, each of the following lines corresponds to an axis of each of the scavenge air ports 10*a*, 10*b*, and 10*c*: The prolongation into the cylinder 4, from the intake port 13 side wall surface of each of the scavenge air ports 10*a*, 10*b*, and 10*c*. The prolongation into the cylinder 4, from the exhaust port 9 side wall surface of each of the scavenge air ports 10*a*, 10*b*, and 10*c*. The prolongation into the cylinder 4, from the line equally dividing into two each of the scavenge air ports 10*a*, 10*b*, and 10*c* as viewed in the cylinder axis direction. The prolongation of lines representing inflow directions of the air-fuel mixture flowing into the cylinder from each of the scavenge air ports 10*a*, 10*b*, and 10*c*. Further, a width in a circumferential direction of the scavenge air port 10*c* that is on the side opposite to the exhaust port is narrowed down in comparison with a width in a circumferential direction of the scavenge air port 10*a* and the scavenge air port 10*b*.

Next, a description will be given of a flow of the air-fuel mixture and the combustion gas in one cycle of the engine 1 according to the present embodiment. When the piston 2 travels to be close to the top dead center, the air-fuel mixture existing within the cylinder 4 is ignited by the ignition plug 17. Further, the air-fuel mixture within the cylinder 4 burns to be a combustion gas, and comes to have a high temperature and a high pressure so as to push down the piston 2 from the top dead center toward the bottom dead center. When the piston 2 travels down, the exhaust port 9 opens first. When the exhaust port 9 opens, the high-pressure combustion gas within the cylinder 4 flows out of the exhaust port 9. At the same time, the air-fuel mixture within the crank chamber 12 is compressed along the downward movement of the piston 2, and the pressure of the air-fuel mixture rises.

When the piston 2 further moves down, the scavenge air port 10*a* and the scavenge air port 10*c* among the scavenge air ports 10 are opened, and the cylinder 4 communicates with the crank chamber 12. Further, when the pressure of the crank chamber 12 becomes higher than the pressure within the cylinder 4, the air-fuel mixture flows into the cylinder 4. Further, when the scavenge air port 10*b* is opened, the air-fuel mixture flows into the cylinder 4 from the scavenge air port 10*b*.

A description will be given of a flow of the air-fuel mixture flowing from the scavenge air port 10 into the cylinder 4. As shown in FIG. 5, the scavenge air port 10*c* is provided in an opposite side to the exhaust port (in the intake port 13 side), and an axis thereof is oriented in such a direction as to be opposite to the exhaust port 9 and is oriented toward the top dead center side. Accordingly, as shown by a thick arrow in the drawing, the air-fuel mixture flowing from the scavenge air port 10*c* of the side opposite to exhaust port which is opened in advance by the downward movement of the piston 2 flows along the side surface in the side opposite to the exhaust port of the cylinder 4. As well, the mixture flows toward an upper region in the vicinity of the ignition plug within the cylinder 4, i.e. in a direction of the top dead center as shown by a thick arrow in FIG. 6, and pushes out the combustion gas to the exhaust port 9.

Figure 6:
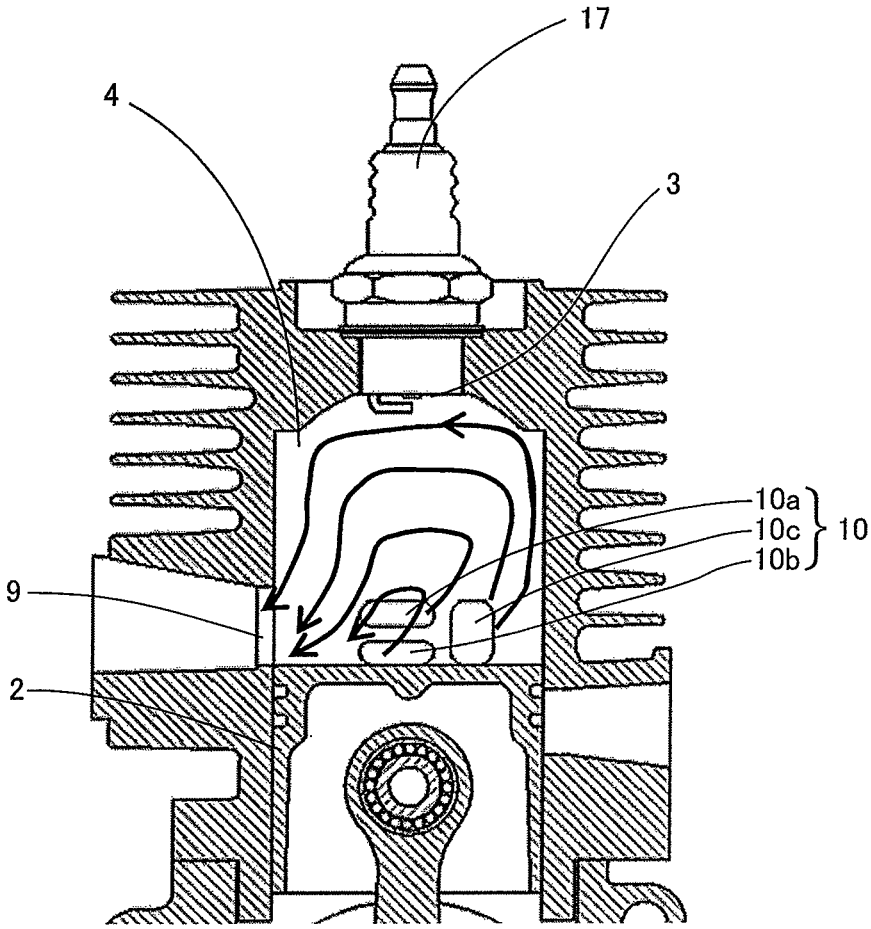
FIG. 6 is an elevated view in section showing a flow of an air-fuel mixture in the engine.

On the other hand, as shown in FIGS. 5 and 6, the scavenge air port 10*a* is closer to the exhaust port 9 in the circumferential direction of the cylinder 4 than the scavenge air port 10*c*, and the axis thereof is directed to the side opposite to the exhaust port 9 and is directed to the top dead center side. Accordingly, as shown by a thick arrow in the drawing, the air-fuel mixture flowing into the cylinder 4 from the scavenge air port 10*a* flows more closely to the exhaust port 9 and the bottom dead center than the air-fuel mixture flowing from the scavenge air port 10*c* of the side opposite to exhaust port does. That is, the mixture flows in the inner side than the air-fuel mixture flowing from the scavenge air port 10*c* in the top-dead-center direction. Further, the air-fuel mixture pushes out to the exhaust port 9 the combustion gas existing in the inner side than the region within the cylinder 4 over which the scavenge air port 10*c* scavenges the combustion gas.

Accordingly, the air-fuel mixture flowing from the scavenge air port 10*c* of the side opposite to exhaust port, and the air-fuel mixture flowing from the scavenge air port 10*a* of the top-dead-center side individually flow toward the different regions within the cylinder 4, and push out the combustion gas remaining in the regions to the exhaust port 9. Therefore, it is possible to efficiently scavenge in the cylinder 4.

Further, as shown in FIG. 5, since the scavenge air port 10*c* of the side opposite to exhaust port is narrowed down in comparison with the scavenge air port 10*a*, as viewed in the cylinder axis direction, a flow rate of the air-fuel mixture flowing from the scavenge air port 10*c* of the side opposite to exhaust port becomes higher than the air-fuel mixture flowing from the scavenge air port 10*a* of the top-dead-center side. Accordingly, it is possible to more effectively scavenge the combustion gas remaining in the upper region within the cylinder 4.

Further, when the piston 2 moves down, the scavenge air port 10*b* of bottom dead center side is opened. The axis of the scavenge air port 10*b* as viewed in the cylinder axis direction is directed to the side opposite to the exhaust port 9 in the same manner as the scavenge air port 10*a* of the top-dead-center side. Accordingly, the air-fuel mixture flowing from the scavenge air port 10*b* of bottom-dead-center side flows into the cylinder 4 along the side surface of the cylinder 4 more closely to the exhaust port 9 than the scavenge air port 10*c* of the side opposite to exhaust port, in the same manner as the air-fuel mixture flowing from the scavenge air port 10*a* of the top dead center side.

Figure 7:
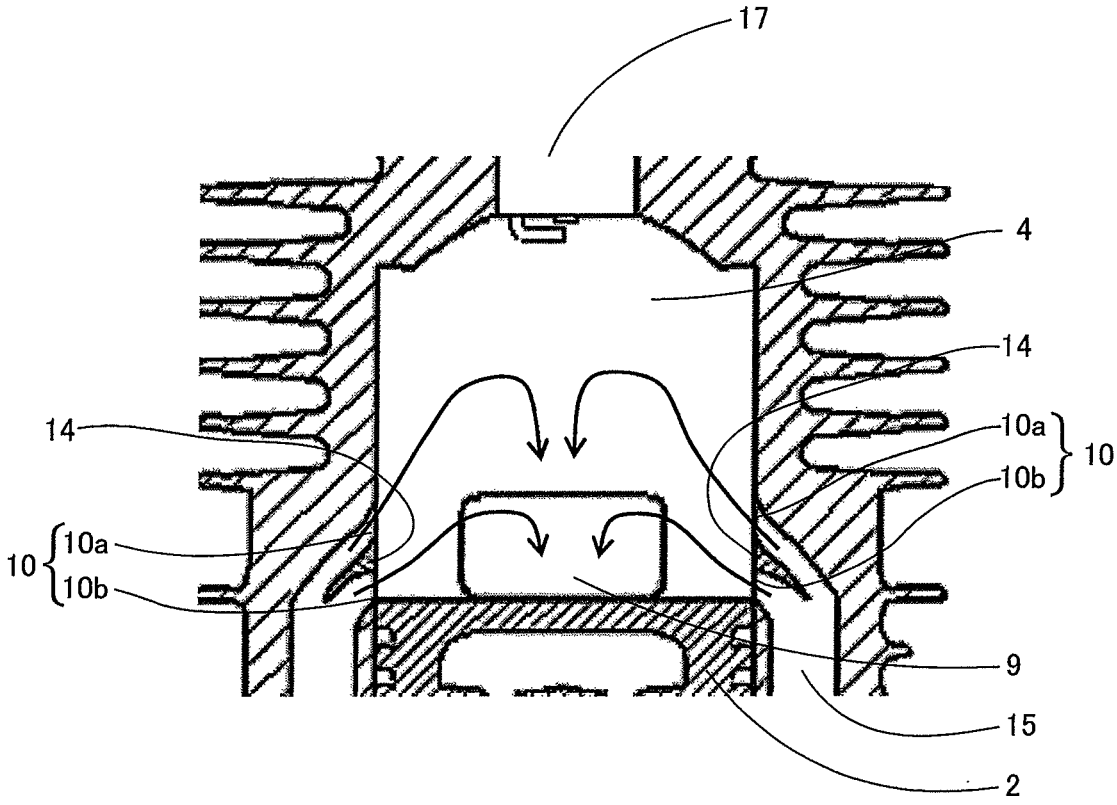
FIG. 7 is a cross sectional view showing the flow of the air-fuel mixture in the engine.

As described above, the dividing portion 14 is provided between the scavenge air port 10*a* of the top dead center side and the scavenge air port 10*b* of bottom-dead-center side. Accordingly, the axis of the scavenge air port 10*b* of bottom-dead-center side is different from the axis of the scavenge air port 10*a* of the top-dead-center side. In other words, the axis of the scavenge air port 10*b* of bottom-dead-center side as viewed in the cylinder axis directions is directed to the bottom dead center side within the cylinder 4 in comparison with the axis of the scavenge air port 10*a* of the top dead center side. Accordingly, as shown by thick arrows in FIGS. 6 and 7, the air-fuel mixture flowing from the scavenge air port 10*b* of bottom-dead-center side flows further in the inner side than the air-fuel mixture flowing from the scavenge air port 10*a* of the top-dead-center side. The air-fuel mixture moves in the direction of the top dead center, and pushes out the combustion gas existing in the vicinity of the center of the cylinder 4 to the exhaust port 9.

Accordingly, the air-fuel mixture flowing from the scavenge air port 10*b* of bottom dead center side can push out to the exhaust port 9 the combustion gas remaining in the different region than the region scavenged by the air-fuel mixture flowing from the scavenge air port 10*c* of the side opposite to the exhaust port 9 and the scavenge air port 10*a* of the top-dead-center side in the vicinity of the center within the cylinder 4. Accordingly, it is possible to further efficiently scavenge in the cylinder 4.

In this case, as described above, the prolongation or the prolonged surface obtained by extending the wall surface 14*a* on the top-dead-center side of the dividing portion 14 in such a direction as to be away from the cylinder 4, and the prolongation or the prolonged surface of the bottom-dead-center-side wall surface 14*b* of the dividing portion are formed to have an intersection 21 or a intersecting line within the scavenge air passage 15. Accordingly, since the flow path resistance within the scavenge air passage of the air-fuel mixture flowing from the crank chamber 12 to the cylinder 4 can be made small, it is possible to efficiently scavenge.

Further, if the piston 2 moves up from the bottom dead center toward the top dead center, the scavenge air port 10*b* of bottom-dead-center side, the scavenge air port 10*a* of the top-dead-center side, the scavenge air port 10*c* of the side opposite to exhaust port, and the exhaust port 9 are closed by the piston 2 in this order. At the same time, since the pressure within the crank chamber 12 is lowered and the air supply port 13 is opened, the air-fuel mixture flows into the crank chamber 12, and the cycle further continues.

As mentioned above, in the two cycle engine 1 according to the present embodiment, the axes, extending into the cylinder 4, of the scavenge air port 10*a* of the top-dead-center side, the scavenge air port 10*b* of bottom-dead-center side and the scavenge air port 10*c* of the side opposite to exhaust port are different from each other. Therefore, the air-fuel mixtures flowing into the cylinder 4 individually from the scavenge air port 10*a* of the top-dead-center side, the scavenge air port 10*b* of the bottom- dead-center side, and the scavenge air port 10*c* of the side opposite to exhaust port flow in different directions within the cylinder 4. Accordingly, the air-fuel mixture moves to push out the combustion gas remaining in the different positions within the cylinder 4 to the exhaust port 9. Therefore, it is possible to efficiently scavenge residual combustion gas within the whole cylinder 4. This yields high concentration of the air-fuel mixture within the cylinder 4, to better improve the output of the two cycle engine 1.

Figure 8:
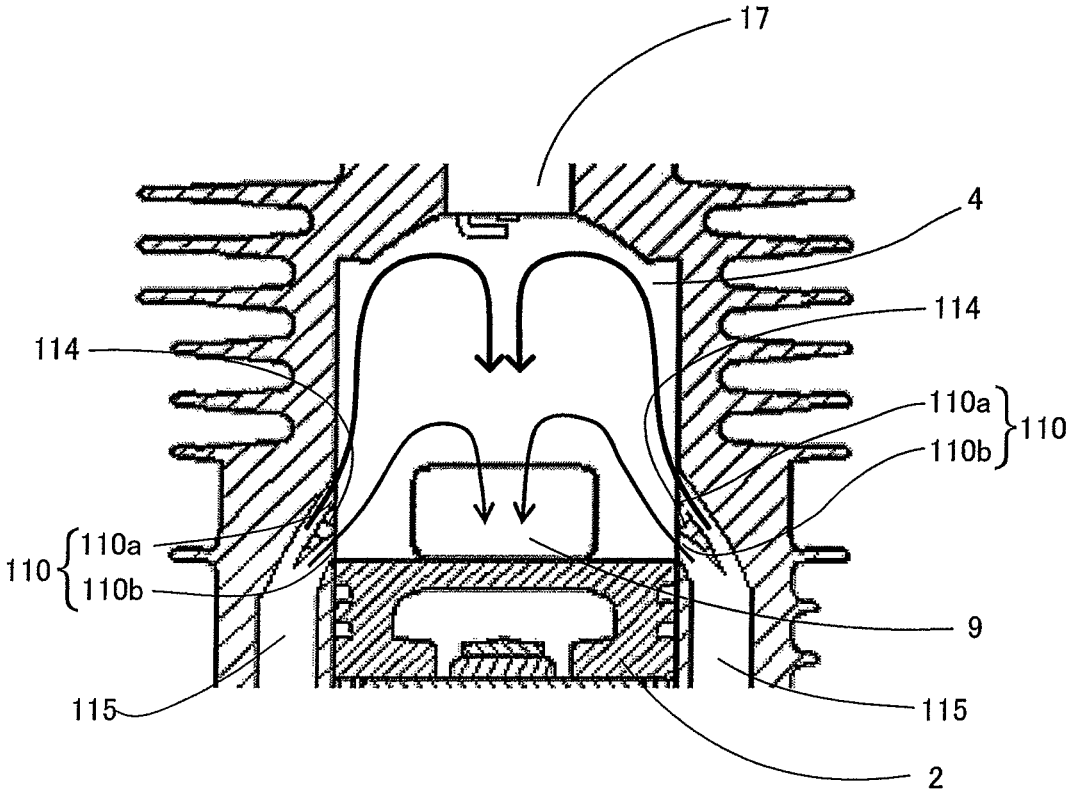
FIG. 8 is an elevated view in sectional view showing a flow of an air-fuel mixture of an engine according to another embodiment.

Another embodiment according to the present invention is described with reference to FIG. 8. As shown in FIG. 8, in this embodiment, an axis of each of scavenge air ports 110 is inclined further to the top dead center in the cylinder axis direction than the above-described embodiment (see FIG. 7; the axes in FIG. 8 are more angled in diagonally upper directions in this drawing). To accommodate to the angle, the shape of a dividing portion 114 and the shape of a scavenge air passage 115 are also changed: this is a sole exception of this construction that is common between the above-described embodiment and this embodiment.

The following is the same as the above embodiments: An axis of a scavenge air port 110*b* of a bottom-dead-center side is different from an axis of a scavenge air port 110*a* of a top-dead-center side. An inclination of the axis of the scavenge air port 110*a* with respect to a surface vertical to the axis of the cylinder 4 is larger than an inclination of the axis of the scavenge air port 110*b* with respect thereto. The axis of the scavenge air port 110*a* of the tope-dead-center side is directed further to an upper side (the top-dead-center side) within the cylinder 4. Therefore, the air-fuel mixtures flowing into the cylinder 4 from the scavenge air port 110*a* of the top-dead-center side and the scavenge air port 110*b* of the bottom-dead-center side flow to individually different directions within the cylinder 4. Accordingly, the air-fuel mixture pushes out the combustion gas remaining in the different positions within the cylinder 4 to the exhaust port 9. Therefore, it is possible to efficiently scavenge the residual combustion gas in the whole inside space of the cylinder 4 to better improve the output of the engine 1 because the concentration of the air-fuel mixture within the cylinder 4 becomes high.

In the two embodiments described above, the axes, prolonged into the cylinder 4, of the scavenge air ports 10*a* and 110*a* of the top-dead-center side, and the axes, prolonged into the cylinder 4, of the scavenge air ports 10*b* and 110*b* of the bottom-dead-center side of the scavenge air ports 10 and 110 are oriented in such a direction as to be opposite to the exhaust port 9, as viewed in the cylinder axis direction. However, the axes of the scavenge air ports 10*a* and 110*a* and the axes of the scavenge air ports 10*b* and 110*b* may be oriented in different directions as viewed in the cylinder axis direction.

Figure 9:
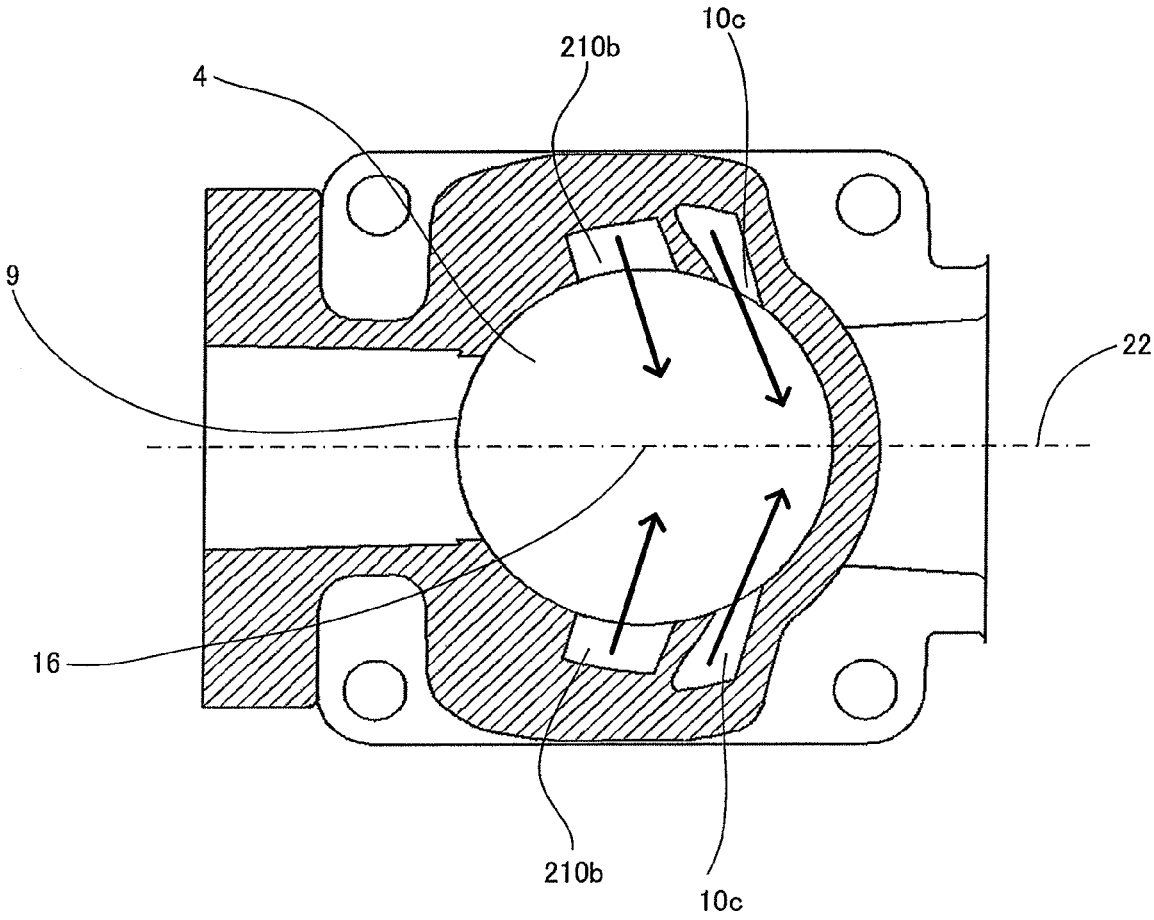
FIG. 9 is a transversal cross sectional view showing a flow of an air-fuel mixture of an engine according to still another embodiment.

For example, as shown in FIG. 9, the axes of both the scavenge air port of the top-dead-center side and the scavenge air port of the bottom-dead-center side are oriented in such a direction as to be away from the exhaust port 9 as viewed in the cylinder axis direction. However, an axis of a scavenge air port 210*b* of the bottom-dead-center side is directed to the side close to the exhaust port 9 in comparison with the axis of the scavenge air port 10*a* of the top-dead-center side. Since the cylinder is so configured, the air-fuel-mixture flow into the cylinder 4 from the scavenge air port 210*b* of the bottom-dead-center side shown by a thick arrow in FIG. 9 flows further into an inner side within the cylinder 4 than the flow shown by FIG. 5. Accordingly, in comparison with the case that the upper and lower scavenge air ports are opened so as to be oriented in the same direction as viewed in the cylinder axis direction, it is possible to more efficiently push out the residual combustion gas within the cylinder 4 to the exhaust port. As a result, the concentration of the air-fuel mixture within the cylinder 4 becomes high, and it is possible to better improve the output of the two cycle engine.

In this case, in each of the embodiments mentioned above, the scavenge air port 10 or 110 is provided with only one dividing portion 14 or 114, respectively. However, a plurality of dividing portions may be provided. In such a structure, it is preferable that a prolongation from the top-dead-center-side wall surface and a prolongation from the top-dead-center-side wall are oriented in appropriate directions so that air-fuel mixture flows from the respective divided scavenge air ports flow into different positions within the cylinder 4. Such a structure results an enhanced efficiency in scavenging the residual combustion gas within the cylinder 4. As a result, the concentration of the air-fuel mixture within the cylinder 4 becomes high, and it is possible to better improve the output of the two cycle engine 1.

Further, in each of the embodiments described above, the scavenge air port 10*c* of the side opposite to the exhaust port is not divided vertically in the cylinder axis direction. However, the dividing portion may be provided in the scavenge air port 10*c* of the side opposite to exhaust port. According to such a configuration, the air-fuel mixture flowing from the scavenge air port 10*c* of the side opposite to exhaust port can be directed to another direction. As a result, it is possible to more efficiently scavenge the combustion gas remaining within the cylinder 4 and better improve the output of the engine 1 by making the concentration of the air-fuel mixture within the cylinder 4 high.

Further, each of the embodiments described above has the scavenge air port 10*c* of the side opposite to exhaust port. However, the engine may not have the scavenge air port 10*c* of the side opposite to exhaust port. In this case, it is desirable to set the axis of each of the scavenge air ports in such a way as an embodiment shown in FIG. 8. In other words, for example, the orientation of the axis of the scavenge air port 110*a* of the top-dead-center side is set such that the air-fuel mixture flowing from the scavenge air port reaches in the vicinity of the ignition plug within the cylinder 4. Further, the axis of scavenge air port 110*b* of the bottom-dead-center side is set such that the air-fuel mixture flowing from the scavenge air port 110*b* of the bottom dead center side flows inside the air-fuel mixture flowing from the scavenge air port 110*a* of the top dead center side. Further, in some cases, the axes of the scavenge air ports 110*a* and 110*b* as viewed in the cylinder axis direction may be structured so as to be different as shown in FIG. 9 described above. Rendering the axes different makes it possible to performs an efficient scavenge even in the case that the scavenge air port 10*c* of the side opposite to exhaust port is not provided.

Figure 10:
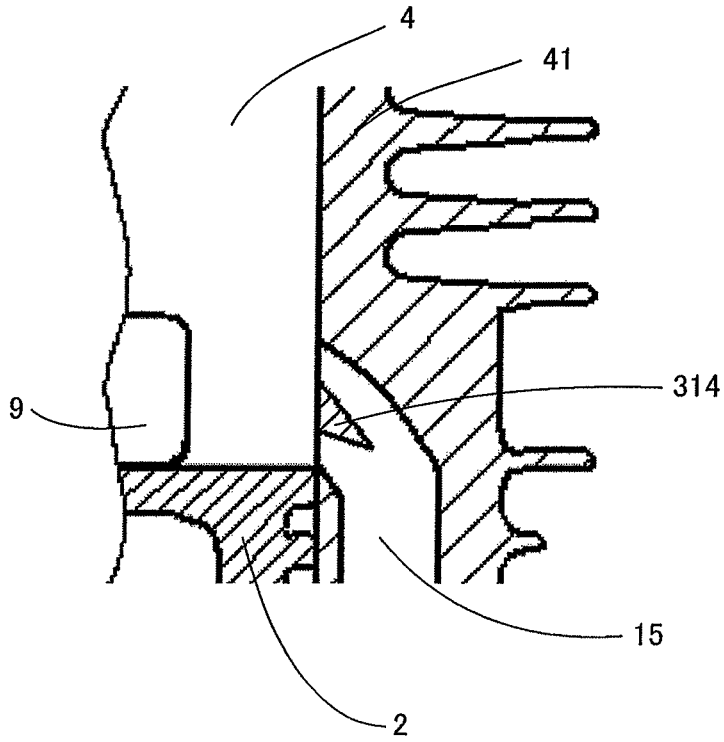
FIG. 10 is an elevated view in section showing a modification of the engine.
Figure 11:
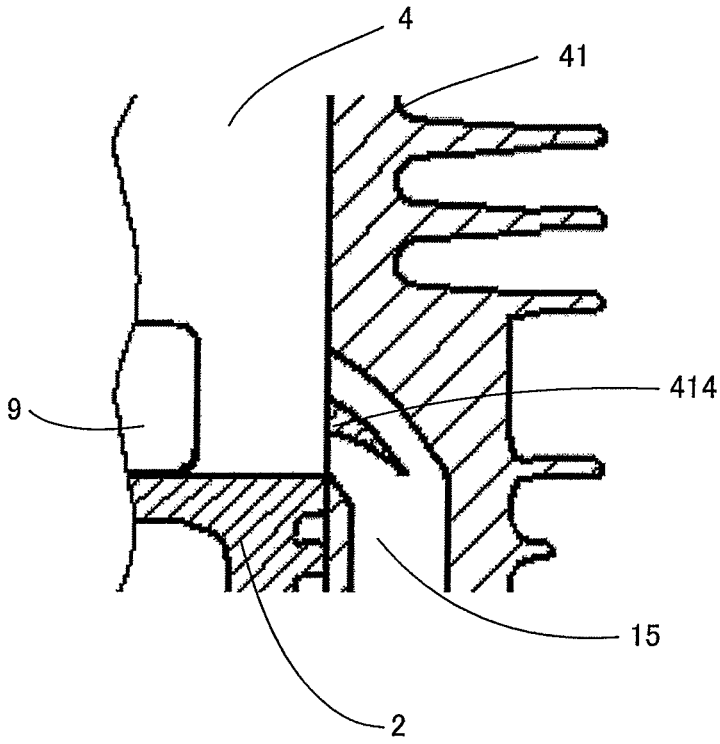
FIG. 11 is an elevated view in section showing another modification of the engine.
Figure 12:
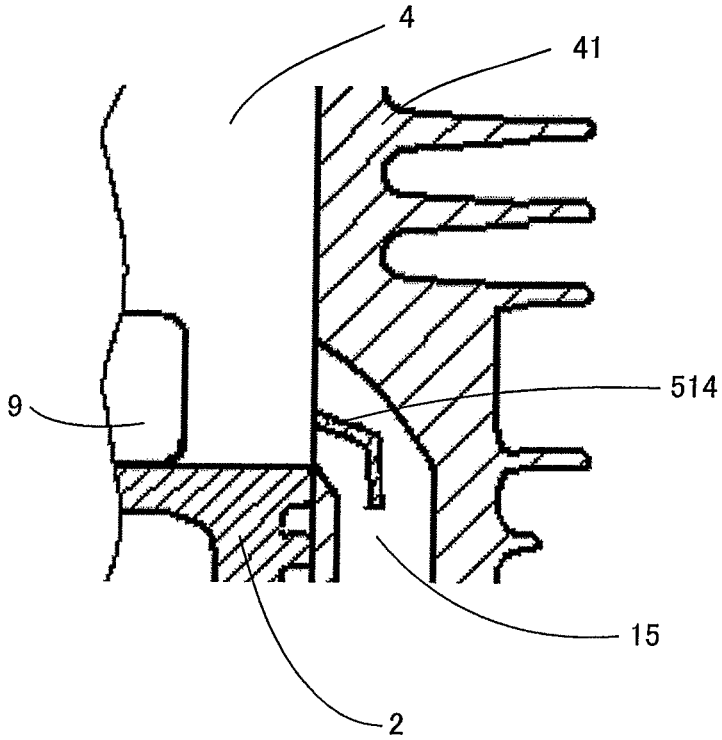
FIG. 12 is an elevated view in section showing still another modification of the engine.

Further, in each of the embodiments described above, the dividing portions 14 and 114 are formed to have an approximately triangular, wedge-shaped cross-section as viewed in the cylinder axis direction. However, the cross sectional shape of the dividing portions 14 and 114 is not limited to a wedge shape. Other shapes may be chosen as far as the inflow direction of the air-fuel mixture into the cylinder 4 can be changed without increase of the flow path resistance of the air-fuel mixture flowing in the scavenge air passages 15 and 115. For example, the cross section of a dividing portion 314 may be a triangular shape as shown in FIG. 10. In this case, since the wall surface of a top-dead-center side and the wall surface of the bottom-dead-center side of the dividing portion 314 are formed approximately flat, the manufacture of the dividing portion 314 is easy, advantageously. Further, a cross section of a dividing portion 414 may be formed as a airfoil shape as shown in FIG. 11. In this case, there can be obtained further advantage that the air-fuel mixture can be introduced into the cylinder 4 without disturbing the flow of the air-fuel mixture flowing in the scavenge air passage 15. Further, a cross section of a dividing portion 514 may be formed to be in an approximately L-shape, as shown in FIG. 12.

The two cycle engine according to the present invention is not limited for use in a bush cutter, but can be applied in various fields, such as other handheld engine-powered tools including chain saws and blowers, and the field of automobiles.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2008-208273 filed on Aug. 12, 2008 and including specification, claims, drawings and summary. The disclosure of the above Japanese Patent Application is incorporated herein by reference in its entirety.

What is claimed is:

1. A two cycle engine comprising:

an exhaust port provided in a side portion of a cylinder; and at least a pair of scavenge air ports provided in the side portion of the cylinder so as to be symmetrical with respect to a plane including an axis of the cylinder and a center line in a cylinder circumference direction of the exhaust port, wherein each scavenge air port is so oriented that, as viewed in a cylinder axis direction, an axis extending to inside of the cylinder from an opening of the scavenge air port extends in such a direction as to be away from the exhaust port of the cylinder, and the scavenge air port is divided in the cylinder axis direction, wherein in a cross-section taken by cutting the dividing portion along a plane including the axis of the cylinder and the center line in the cylinder circumference direction of the scavenge air port, a prolongation prolonged from a top-dead-center-side wall of the scavenge air port of a top-dead-center side is angled toward the top-dead-center side with respect to a line that is vertical to the axis of the cylinder, and a first angle formed by a first line and a second line is larger than a second angle formed by the second line and a third line, and wherein the first line is formed by the prolongation from the top-dead-center-side wall of the scavenge air port of the top-dead-center side, the second line is vertical to the cylinder axis, and the third line is formed by a prolongation into the cylinder from a top-dead-center-side wall of the scavenge air port of a bottom-dead-center side.

2. The two cycle engine according to claim 1, further comprising a dividing portion that divides the scavenge air port in the cylinder axis direction, wherein the dividing portion is so thinned out that its thickness decreases according to a distance from the cylinder in a cross-section taken by cutting the dividing portion along a plane through which passes the center line in the cylinder circumference direction of the scavenge air port and which is in parallel with the cylinder axis, and which is along a direction of scavenge air flow through each scavenge air port.

3. The two cycle engine according to claim 1, wherein the cylinder further comprises a second scavenge air port that locates more apart from the exhaust port than the scavenge air ports, and is adjacent to the scavenge air ports.

4. A tool comprising the two cycle engine according to any one of claims 1, 2 and 3.

* * * * *